US011619160B2

(12) United States Patent
Ha et al.

(10) Patent No.: US 11,619,160 B2
(45) Date of Patent: Apr. 4, 2023

(54) APPARATUS AND METHOD OF CONTROLLING HEAT OF ENGINE COMPARTMENT OF VEHICLE WHEN STOPPED

(71) Applicants: Hyundai Motor Company, Seoul (KR); Kia Corporation, Seoul (KR)

(72) Inventors: Dong Su Ha, Gyeonggi-do (KR); Tae Kwang Eom, Gyeonggi-do (KR); Dong Jun Shin, Gyeonggi-do (KR); Jeong Ho Byeon, Gyeonggi-do (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/532,165

(22) Filed: Nov. 22, 2021

(65) Prior Publication Data

US 2022/0186656 A1 Jun. 16, 2022

(30) Foreign Application Priority Data

Dec. 16, 2020 (KR) ..... 10-2020-0176576

(51) Int. Cl.
*F01P 5/06* (2006.01)

(52) U.S. Cl.
CPC ..... *F01P 5/06* (2013.01); *F01P 2025/13* (2013.01); *F01P 2025/66* (2013.01)

(58) Field of Classification Search
CPC . F01P 5/06; F01P 2025/13; F01P 7/10; B60K 11/085; B60K 11/06
See application file for complete search history.

(56) References Cited

U.S. PATENT DOCUMENTS

| | | | | |
|---|---|---|---|---|
| 2017/0291600 | A1* | 10/2017 | Styles | F02D 41/021 |
| 2018/0022210 | A1* | 1/2018 | Matsumura | F01P 7/12 123/41.05 |
| 2018/0202347 | A1* | 7/2018 | Brinkmann | F01P 7/16 |
| 2018/0347493 | A1* | 12/2018 | Tascillo | F02D 41/22 |
| 2019/0031199 | A1* | 1/2019 | Dudar | B60K 11/085 |
| 2020/0149461 | A1* | 5/2020 | Shidara | F01P 5/06 |
| 2021/0291640 | A1* | 9/2021 | Srivastava | G07C 5/0816 |
| 2021/0317772 | A1* | 10/2021 | Tan | B60K 11/085 |
| 2022/0089017 | A1* | 3/2022 | Kim | B60K 11/085 |

* cited by examiner

*Primary Examiner* — Long T Tran
(74) *Attorney, Agent, or Firm* — Fox Rothschild LLP

(57) ABSTRACT

An apparatus and method of controlling heat of an engine compartment when stopped are provided. The apparatus and method of controlling heat of an engine compartment improve fuel efficiency by managing heat of the engine compartment when a vehicle is stopped after driving.

16 Claims, 2 Drawing Sheets

APPARATUS AND METHOD OF CONTROLLING HEAT OF ENGINE COMPARTMENT OF VEHICLE WHEN STOPPED

CROSS-REFERENCE TO RELATED APPLICATION

This application claims under 35 U.S.C. § 119(a) the benefit of priority to Korean Patent Application No. 10-2020-0176576 filed on Dec. 16, 2020, the entire contents of which are incorporated herein by reference.

BACKGROUND

(a) Technical Field

The present disclosure relates to an apparatus and method of controlling heat of an engine compartment when a vehicle is stopped, and more particularly to an apparatus and method of controlling heat of an engine compartment for improving fuel efficiency by managing heat of the engine compartment when a vehicle is stopped after driving.

(b) Background Art

In general, an active air flap (AAF) system controls an operation of an AAF disposed between a radiator grill and a radiator of a vehicle. The AAF is disposed in front of the radiator to open and close the radiator grill that functions as a vent of an engine compartment. The AAF system reduces air resistance of the vehicle and improves driving stability by closing the radiator grill through a close operation of the AAF when the vehicle travels at high speed, and when the temperature of the engine compartment increases while driving and there is a concern about overheating of parts disposed in the engine compartment, the temperature of the engine compartment is reduced by opening the radiator grill through an open operation of the AAF.

A conventional AAF system mainly uses an AAF to improve aerodynamic performance while driving. For example, an open and close operation of a conventional AAF is determined based on an outdoor temperature, an engine coolant temperature, a transmission oil temperature, a temperature of an inverter for a motor, a temperature of an inverter for a hybrid starter generator (HSG), and a temperature of a low voltage DC-DC convertor (LDC) to improve aerodynamics while driving. In the conventional AAF system, the operation of the AAF is controlled only while driving, and thus the operation of the AAF is not considered in a situation in which a vehicle is stopped after driving.

The temperature of an engine compartment decreases based on an outdoor temperature when a vehicle is stopped, and when the outdoor temperature is very low, the temperature of the engine compartment decreases to a level at which engine warm-up is delayed upon restart, and there is a problem in that fuel efficiency of a vehicle decreases when engine warm-up is delayed upon restart.

SUMMARY

In one aspect, the present disclosure provides an apparatus and method of controlling heat of an engine compartment for managing heat of the engine compartment and improving fuel efficiency when a vehicle is stopped by controlling an operation of an active air flap (AAF) when an engine is turned off based on information on an environment condition monitored while driving and a vehicle state.

According to some embodiments of the present disclosure, an apparatus for controlling heat of an engine compartment when a vehicle is stopped may include an active air flap (AAF) configured to open and close a vent of the engine compartment, and a controller configured to determine whether a heat management mode for reducing heat dissipation of the engine compartment when stopped and a degradation protection mode for preventing degradation of parts of the engine compartment are required, and to operate the AAF to close the vent when an engine is turned off in response to determining that the heat management mode is required and the degradation protection mode is not required.

The apparatus for controlling heat of the engine compartment according to an embodiment of the present disclosure may have the following features.

The controller may be configured to monitor an outdoor temperature and an engine compartment degradation factor of the vehicle while driving, determine whether the heat management mode is required based on the outdoor temperature, and determine whether the degradation protection mode is required based on the engine compartment degradation factor.

In response to determining that heat management mode is required and the degradation protection mode is not required, the vent of the engine compartment may be maintained in a closed state when stopped in a state in which the engine is turned off. In other words, the AAF may maintain the vent of the engine compartment in a closed state when stopped upon engine off.

In response to determining that the heat management mode is not required and the degradation protection mode is required, that both the heat management mode and the degradation protection mode are required, or that both the heat management mode and the degradation protection mode are not required, the controller may be configured to operate the AAF to open the vent of the engine compartment when the engine is turned off.

In response to determining that the heat management mode is not required and the degradation protection mode is required, that both the heat management mode and the degradation protection mode are required, or that both the heat management mode and the degradation protection mode are not required, the vent of the engine compartment may be maintained in an open state when stopped in a state in which the engine is turned off. In other words, the AAF may maintain the vent of the engine compartment when stopped in an engine-off state.

The controller may be configured to determine whether a radiator fan disposed in the engine compartment is operated before the AAF is operated to close the vent when the engine is turned off, and when the radiator fan is operated upon engine off, even if it is determined that the heat management mode is required and the degradation protection mode is not required, the controller may be configured to operate the AAF to open the vent. When the radiator fan is not operated upon engine off, if it is determined that the heat management mode is required and the degradation protection mode is not required, the controller may be configured to operate the AAF to close the vent.

According to some embodiments of the present disclosure, a method of controlling heat of an engine compartment when a vehicle is stopped may include monitoring an outdoor temperature and an engine compartment degradation factor of the vehicle while driving, determining whether a heat management mode for reducing heat dissipation of the engine compartment when stopped in an engine-off state is required based on the outdoor temperature, determining whether a degradation protection mode for preventing degradation of parts of the engine compartment when stopped in the engine-off state is required based on the engine compartment degradation factor, and in response to determining that the heat management mode is required and the degradation protection mode is not required, operating an active air flap (AAF) to close a vent of an engine compartment when an engine is turned off.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein.

DETAILED DESCRIPTION

Hereinafter, exemplary embodiments of the present disclosure will be described with reference to the accompanying drawings. Features shown in the accompanying drawings are schematically drawn for easy explanation of the embodiments of the present disclosure and may be different from those actually implemented.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 1:
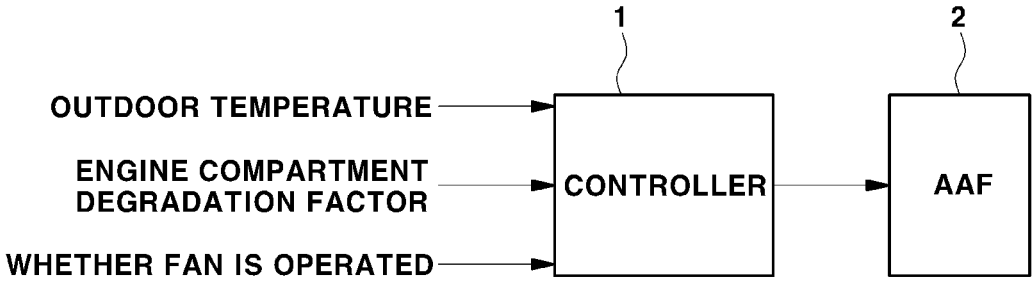
FIG. 1 is a diagram showing the configuration for performing a method of controlling heat of an engine compartment when a vehicle is stopped according to the present disclosure.
Figure 2:
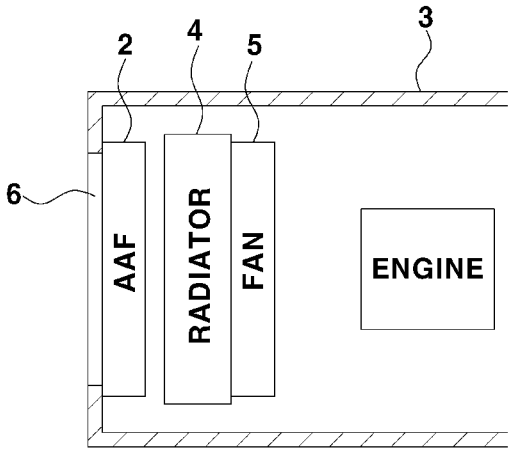
FIG. 2 is a diagram showing an example of an engine compartment to which a method of controlling heat of an engine compartment is applied according to the present disclosure.
Figure 3:
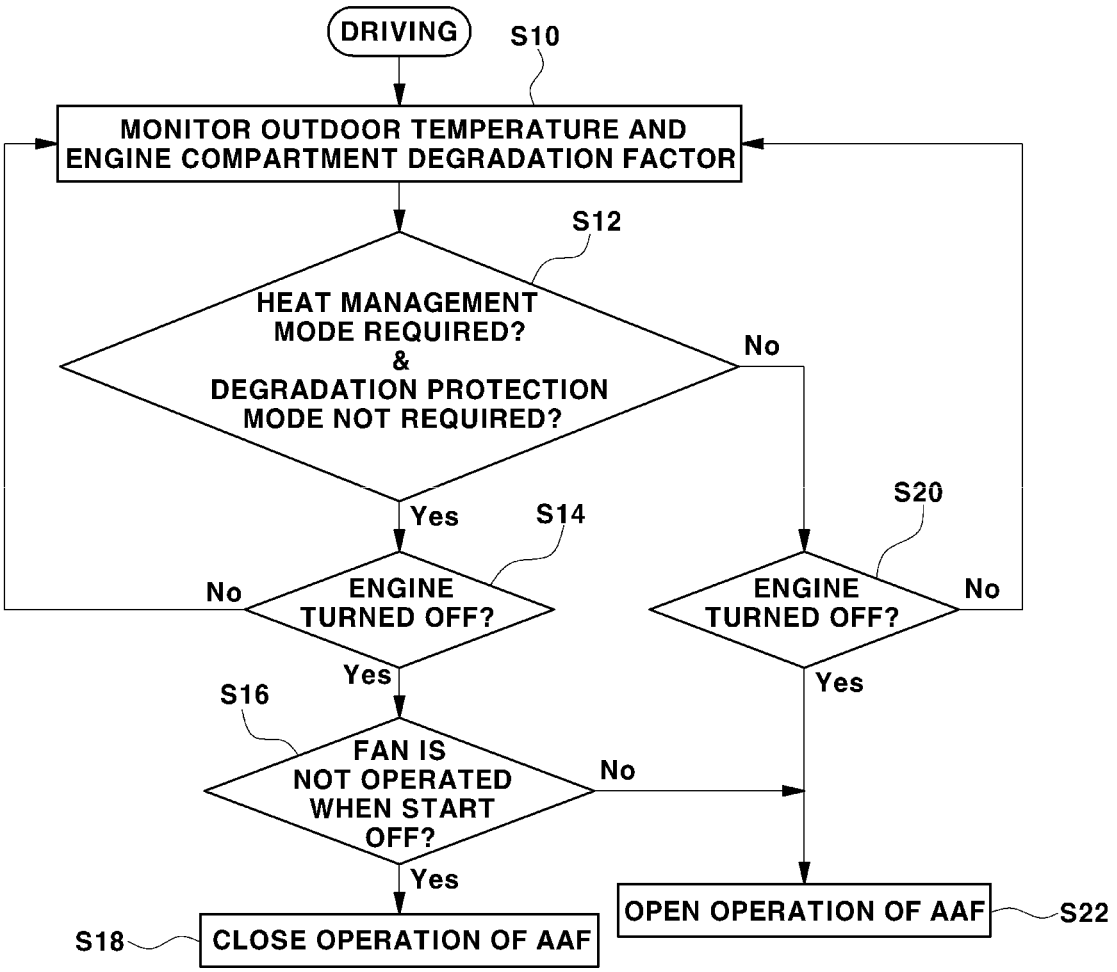
FIG. 3 is a flowchart showing a method of controlling heat of an engine compartment when a vehicle is stopped according to the present disclosure.

FIG. 1 is a diagram showing the configuration for performing a method of controlling heat of an engine compartment when a vehicle is stopped according to the present disclosure. FIG. 2 is a diagram showing an example of an engine compartment to which a method of controlling heat of an engine compartment is applied according to the present disclosure. FIG. 3 is a flowchart showing a method of controlling heat of an engine compartment when a vehicle is stopped according to the present disclosure.

As shown in FIG. 1, an active air flap (AAF) 2 may be operated according to a command of a controller 1, and the controller 1 may be configured to operate the AAF 2 when an engine is turned off based on information that is received while driving. The controller 1 may be an engine controller that is pre-installed in the vehicle.

Referring to FIG. 2, the AAF 2 may be configured to open and close a vent 6 of an engine compartment 3 and may be installed in the engine compartment 3 to be disposed at the rear of the vent 6. In particular, the AAF 2 may be disposed in front of a radiator 4 for cooling an engine coolant. The AAF 2 may be installed in the engine compartment 3 while being supported at a vehicle body, and the vent 6 may be a general radiator grill.

Hereinafter, a method of controlling heat of an engine compartment when a vehicle is stopped according to the present disclosure will be described more with reference to FIG. 3. The method described herein below may be executed by the controller. As shown in FIG. 3, an outdoor temperature and an engine compartment degradation factor may be periodically monitored while a vehicle travels (S10). The outdoor temperature may be detected by an outdoor temperature sensor installed in the vehicle. For example, the controller 1 may be configured to monitor the outdoor temperature of the vehicle based on the information received from the outdoor temperature sensor.

In particular, the outdoor temperature may be monitored using an average of outdoor temperatures detected while the vehicle travels. The controller 1 may be configured to monitor a value obtained by sampling information on the outdoor temperature detected by the outdoor temperature sensor at a predetermined time interval, summing the sampled values, and averaging the values. For example, the controller 1 may be configured to calculate and monitor an average outdoor temperature by accumulatively summing and averaging 10 pieces of outdoor temperature information detected most recently every 30 seconds by the outdoor temperature sensor.

Whether a heat management mode is required when a vehicle is stopped in an engine-off state may be determined based on the outdoor temperature monitored in operation S10. In other words, whether the heat management mode is required may be periodically determined depending on the outdoor temperature value.

The heat management mode may be a control mode for reducing heat dissipation and temperature reduction of the engine compartment 3 when the vehicle is stopped in an engine-off state while driving. When the heat management mode is determined to be required, the vent 6 of the engine compartment 3 may be closed to minimize heat dissipation of the engine compartment 3 to the outside.

To determine whether the heat management mode is required, the outdoor temperature monitored in operation S10 may be compared with a preset reference outdoor temperature x. When the outdoor temperature is equal to or less than the reference outdoor temperature x, the controller 1 may be configured to determine that the heat management mode is required, and when the outdoor temperature is greater than the reference outdoor temperature x, the controller 1 may be configured to determine that the heat management mode is not required. In other words, the controller 1 may be configured to periodically determine whether the heat management mode is required using the outdoor temperature information.

The reference outdoor temperature x may be determined as an optimum value derived through a pre-test, evaluation, etc. In particular, the reference outdoor temperature x may be determined as a temperature that excessively reduces the temperature of an engine compartment when the vehicle is stopped. When the vehicle is stopped in an engine-off state in a condition in which the outdoor temperature is very low, the temperature of the engine compartment may be reduced to a very low temperature, and engine warm-up may be delayed upon restart of an engine, and accordingly, the fuel efficiency of the vehicle may be degraded. For example, the reference outdoor temperature x may be determined as a subzero temperature. Thus, heat dissipation of the engine compartment 3 to the outside may be reduced by determining that the heat management mode is required when the outdoor temperature is equal to or less than the reference outdoor temperature x, thereby improving engine startability and fuel efficiency.

When the vehicle is stopped in a temperature condition in which there is a concern about degradation of parts of the engine compartment 3, the temperature of the engine compartment may be further increased immediately after the engine is turned off, and accordingly, when heat of the engine compartment is not dissipated to the outside, parts disposed in the engine compartment may be degraded. Accordingly, when there is a concern about degradation of parts of the engine compartment 3, temperature reduction of the engine compartment 3 may be induced by opening the vent 6 of the engine compartment 3.

The engine compartment degradation factor monitored in operation S10 may include an accumulated fuel amount, a vehicle speed, an engine intake temperature, an exhaust gas temperature, and an engine coolant temperature. The engine compartment degradation factor may be a factor that increases the temperature of the engine compartment 3 while driving. Thus, whether a part is degraded due to temperature increase of the engine compartment 3 may be determined based on the engine compartment degradation factor, and when the vehicle is stopped in an engine-off state, whether a degradation protection mode for preventing degradation of parts of the engine compartment 3 is required may be determined based on the engine compartment degradation factor.

The controller 1 may be configured to compare engine compartment degradation factors with respective reference values and determine whether the degradation protection mode is required according to the comparison result. In particular, among the engine compartment degradation factors, the controller 1 may be configured to compare the accumulated fuel amount with a reference fuel amount a, compare the vehicle speed with a reference vehicle speed b, compare the engine intake temperature with a reference intake temperature c, compare the exhaust gas temperature with a reference gas temperature d, and compare the engine coolant temperature with a reference coolant temperature e, and according to the comparison result, the controller 1 may be configured to determine whether the degradation protection mode is required.

The accumulated fuel amount may be the amount of fuel consumed while driving after starting the engine, and the exhaust gas temperature may be a temperature of exhaust gas detected by an engine exhaust system while driving. The engine intake temperature may be a temperature of air flowing into an intake system of an engine from the engine compartment 3, and the engine coolant temperature may be a temperature of an engine coolant that is discharged from the engine and flows into the radiator 4.

The reference fuel amount a, the reference vehicle speed b, the reference intake temperature c, the reference gas temperature d, and the reference coolant temperature e may each be determined as a value derived through a pre-test, evaluation, etc., and in detail, may be set to a value that causes degradation of parts due to temperature rise of the engine compartment 3.

The controller 1 may be configured to determine whether the degradation protection mode is required by synthesizing the results of the comparison between the engine compartment degradation factors and the reference values a, b, c, d, and e. In particular, in response to determining that the accumulated fuel amount is equal to or less than the reference fuel amount a, the vehicle speed is equal to or less than the reference vehicle speed b, the engine intake temperature is equal to or less than the reference intake temperature c, the exhaust gas temperature is equal to or less than the reference gas temperature d, and the engine coolant temperature is equal to or less than the reference coolant temperature e, the controller 1 may be configured to determine that the degradation protection mode is required.

The controller 1 may be configured to determine that the degradation protection mode is not required when a condition in which at least one of the accumulated fuel amount, the vehicle speed, the engine intake temperature, the exhaust gas temperature, and the engine coolant temperature is equal to or less than the reference values a, b, c, d, and e is not satisfied. In particular, the accumulated fuel amount, the vehicle speed, the engine intake temperature, the exhaust gas temperature, and the engine coolant temperature may be monitored based on information received from various sensors installed in the vehicle while driving.

The engine compartment degradation factors may be periodically monitored as an average thereof. In particular, the controller 1 may be configured to monitor a value obtained by sampling information on the accumulated fuel amount based on information on a residual fuel amount detected by a fuel sender while driving, summing the sampled values, and averaging the values. The fuel sender may be configured to detect a residual fuel amount in a fuel tank, and the accumulated fuel amount may be calculated by subtracting the residual fuel amount, detected by the fuel sender while driving, from the fuel amount in the fuel tank at engine start. For example, the controller 1 may be configured to monitor an average accumulated fuel amount obtained by accumulatively summing and averaging 10 pieces of accumulated fuel amount information detected most recently every 100 seconds while driving.

The controller 1 may be configured to monitor an average vehicle speed obtained by sampling vehicle speed information detected by a vehicle speed sensor while driving at a predetermined time interval and averaging the values. For example, the controller 1 may be configured to monitor an average vehicle speed obtained by averaging 100 pieces of vehicle speed information detected most recently every 30 seconds while driving. The controller 1 may be configured to monitor an average intake temperature obtained by sampling information on the engine intake temperature detected by an intake temperature sensor while driving at a predetermined time interval and averaging the values. For example, the controller 1 may be configured to monitor an average intake temperature obtained by averaging 100 pieces of intake temperature information detected most recently every 30 seconds while driving.

Additionally, the controller 1 may be configured to monitor an average exhaust gas temperature obtained by sampling exhaust gas temperature information detected by an exhaust temperature sensor while driving at a predetermined time interval and averaging the values. For example, the controller 1 may be configured to monitor an average exhaust gas temperature obtained by averaging 100 pieces of exhaust gas temperature information detected most recently every 30 seconds while driving. The controller 1 may be configured to monitor an average coolant temperature obtained by sampling information on the engine intake temperature detected by a coolant temperature sensor while driving at a predetermined time interval and averaging the values. For example, the controller 1 may be configured to monitor an average coolant temperature obtained by averaging 100 pieces of coolant temperature information detected most recently every 30 seconds while driving.

Whether the heat management mode and the degradation protection mode are required may be periodically determined based on the outdoor temperature and engine compartment degradation factor information that are monitored as described above, and according to the determination result, heat of the engine compartment 3 may be effectively adjusted by controlling an open and close operation of the AAF 2 when an engine is turned off.

The controller 1 may be configured to monitor the outdoor temperature and the engine compartment degradation factor and then determine whether the heat management mode is required and whether the degradation protection mode is not required (S12). In other words, in operation S12, whether the heat management mode is required may be determined, and simultaneously, whether the degradation protection mode is not required may be determined. In response to determining that the heat management mode is required and the degradation protection mode is not required, whether an engine off request signal is generated may be determined (S14), and when the engine off request signal is generated, the AAF 2 may be operated to close the vent 6 of the engine compartment 3 (S18).

When a driver requests an engine to be turned off by manipulating an ignition key, the engine off request signal may be input to the controller 1, and the controller 1 may be configured to turn off the engine according to the engine off request. In response to determining that the heat management mode is required and the degradation protection mode is not required, the AAF 2 may be configured to close the vent 6 of the engine compartment 3 when the engine is turned off.

When a vehicle is stopped in the state in which the engine is turned off, the AAF 2 may be configured to maintain the vent 6 in a close operation state (i.e., a close operation mode), and the vent 6 may be maintained in a closed state while stopped. In operation S18, before the AAF 2 is operated in a close mode, whether a radiator fan 5 is operated may be determined. In other words, before the AAF 2 is operated in a close mode when the engine is turned off, whether the radiator fan 5 is driven may be determined.

Referring to FIG. 2, the radiator fan 5 may be installed in the engine compartment 3 to be disposed at the rear of the radiator 4 and may be driven to improve cooling performance of the radiator 4. An engine coolant may circulate and flow in the radiator 4, and when the radiator fan 5 is driven, a flow rate of air blown to the radiator 4 may be increased, and accordingly, the engine coolant may be rapidly cooled.

When the radiator fan 5 is driven, the flow of external air flowing into the engine compartment 3 may be increased, and the temperature of the engine compartment 3 may be more rapidly reduced than in the case in which the radiator fan 5 is not driven. The case in which the radiator fan 5 is driven may be determined to be the situation in which the engine compartment 3 needs to be further cooled by forcibly introducing external air into the engine compartment 3.

Accordingly, whether the radiator fan 5 is operated when an engine is turned off may be determined (S16), and when the radiator fan 5 is operated when the engine is turned off, even if it is determined that the heat management mode is required and the degradation protection mode is not required in operation S12, the AAF 2 may be operated in an open mode to open the vent 6 of the engine compartment 3 (S22).

As the determination result of operation S16, when the radiator fan 5 is not operated, the AAF 2 may be operated in a close mode according to the determination result of operation S12 to close the vent 6 of the engine compartment 3 (S18). In other words, in operation S12, in response to determining that the heat management mode is required and the degradation protection mode is not required, whether the radiator fan 5 is not required when the engine is turned off may be determined (S16), and when the radiator fan 5 is not operated, the AAF 2 may be operated in a close mode (S18).

As the determination result of operation S12, in response to determining that the heat management mode is not required and the degradation protection mode is required, whether the engine off request signal is generated may be determined (S20), and when the engine off request signal is generated and the engine is turned off, the AAF 2 may be operated to open the vent 6 of the engine compartment 3 (S22).

As the determination result of operation S12, in response to determining that the heat management mode and the degradation protection mode are simultaneously required, the degradation protection mode may be prioritized. In other words, in response to determining that both the heat management mode and the degradation protection mode are required, the AAF 2 may be operated to open the vent 6 of the engine compartment 3 when the engine is turned off (S22).

Engine startability and fuel efficiency may be improved through the heat management mode of the engine compartment 3, and furthermore, parts in the engine compartment 3 may be prevented from being degraded through the degradation protection mode of the engine compartment 3. When the vehicle is stopped in the state in which the engine is turned off, the AAF 2 may be configured to maintain the vent 6 in an open operation state (i.e., an open operation mode), and the vent 6 may also be maintained in an open state when stopped. As the determination result in operation S12, in response to determining that both the heat management mode and the degradation protection mode are not required, the AAF 2 may also be operated in an open mode when the engine is turned off to open the vent 6 of the engine compartment 3 (S22).

Through the solutions of the above problems, the present disclosure may effectively manage heat of an engine compartment when stopped and may improve fuel efficiency by controlling an operation of an AAF when an engine is turned off based on information on an environment condition monitored while driving and a vehicle state.

As the embodiments of the present disclosure have been described in detail above, terms or words used in the specification and claims should not be construed as being limited to a conventional or dictionary meaning, and since the embodiments described in the present specification and the configuration shown in the drawings are only an exemplary embodiment of the present disclosure, the scope of the present disclosure is not limited to the aforementioned embodiments, and various modifications and improvements by those skilled in the art based on the following claims are also included in the scope of the present disclosure.

What is claimed is:

1. An apparatus for controlling heat of an engine compartment when a vehicle is stopped, the apparatus comprising:

an active air flap (AAF) configured to open and close a vent of the engine compartment; and a controller configured to:

monitor an outdoor temperature and an engine compartment degradation factor of the vehicle while driving, determine whether a heat management mode for reducing heat dissipation of the engine compartment when the vehicle is stopped in an engine off-state is required based on the monitored outdoor temperature, determine whether a degradation protection mode for preventing degradation of parts of the engine compartment when the vehicle is stopped in the engine-off state is required based on the engine compartment degradation factor, operate the AAF to close the vent when an engine is turned off in response to determining that the heat management mode is required and the degradation protection mode is not required, and operate the AAF to open the vent when the vehicle is stopped in a state in which the engine is turned off and both the heat management mode and the degradation protection mode are required.

2. The apparatus of claim 1, wherein, in response to determining that the heat management mode is not required and the degradation protection mode is required, the controller is configured to operate the AAF to open the vent of the engine compartment when the engine is turned off.

3. The apparatus of claim 1, wherein, in response to determining that both the heat management mode and the degradation protection mode are not required, the controller is configured to operate the AAF to open the vent of the engine compartment when the engine is turned off.

4. The apparatus of claim 1, wherein, in response to determining that heat management mode is required and the degradation protection mode is not required, the vent of the engine compartment is maintained in a closed state when the vehicle is stopped in a state in which the engine is turned off.

5. The apparatus of claim 1, wherein, in response to determining that the heat management mode is not required and the degradation protection mode is required or that both the heat management mode and the degradation protection mode are not required, the vent of the engine compartment is maintained in an open state when the vehicle is stopped in a state in which the engine is turned off.

6. The apparatus of claim 1, wherein the controller is configured to determine whether a radiator fan disposed in the engine compartment is operated before the AAF is operated to close the vent when the engine is turned off, and when the radiator fan is operated upon engine off, even if it is determined that the heat management mode is required and the degradation protection mode is not required, the controller is configured to operate the AAF to open the vent.

7. The apparatus of claim 6, wherein, when the radiator fan is not operated upon engine off, in response to determining that the heat management mode is required and the degradation protection mode is not required, the controller is configured to operate the AAF to close the vent.

8. The apparatus of claim 1, wherein the engine compartment degradation factor comprises an accumulated fuel amount, a vehicle speed, an engine intake temperature, an exhaust gas temperature, and an engine coolant temperature.

9. A method of controlling heat of an engine compartment when a vehicle is stopped, the method comprising:

monitoring, by a controller, an outdoor temperature and an engine compartment degradation factor of the vehicle while driving;

determining, by the controller, whether a heat management mode for reducing heat dissipation of the engine compartment when the vehicle is stopped in an engine-off state is required based on the outdoor temperature;

determining, by the controller, whether a degradation protection mode for preventing degradation of parts of the engine compartment when the vehicle is stopped in the engine-off state is required based on the engine compartment degradation factor;

in response to determining that the heat management mode is required and the degradation protection mode is not required, operating, by the controller, an active air flap (AAF) to close a vent of an engine compartment when an engine is turned off, and in response to determining that both the heat management mode and the degradation protection mode are required, operating the AAF to open the vent of the engine compartment when the vehicle is stopped in a state in which the engine is turned off.

10. The method of claim 9, further comprising: in response to determining that the heat management mode is not required and the degradation protection mode is required, operating, by the controller, the AAF to open the vent of the engine compartment when the engine is turned off.

11. The method of claim 9, wherein, in response to determining that both the heat management mode and the degradation protection mode are not required, operating, by the controller, the AAF to open the vent of the engine compartment when the engine is turned off.

12. The method of claim 9, wherein, in response to determining that the heat management mode is required and the degradation protection mode is not required, maintaining, by the controller, the vent of the engine compartment in a closed state when the vehicle is stopped in a state in which the engine is turned off.

13. The method of claim 9, wherein, in response to determining that the heat management mode is not required and the degradation protection mode is required, or that both the heat management mode and the degradation protection mode are not required, maintaining, by the controller, the vent of the engine compartment in an open state when the vehicle is stopped in a state in which the engine is turned off.

14. The method of claim 9, further comprising: determining, by the controller, whether a radiator fan is operated before the AAF is operated to close the vent when the engine is turned off, wherein, when the radiator fan is operated when the engine is turned off, even if it is determined that the heat management mode is required and the degradation protection mode is not required, the AAF is operated to open the vent of the engine compartment.

15. The method of claim 14, wherein, when the radiator fan is not operated upon engine off, in response to determining that the heat management mode is required and the degradation protection mode is not required, the AAF is operated to close the vent of the engine compartment.

16. The method of claim 9, wherein the engine compartment degradation factor includes an accumulated fuel amount, a vehicle speed, an engine intake temperature, an exhaust gas temperature, and an engine coolant temperature.

* * * * *